US011148425B2

(12) United States Patent
Sawadaishi

(10) Patent No.: US 11,148,425 B2
(45) Date of Patent: Oct. 19, 2021

(54) LIQUID DISCHARGE DEVICE

(71) Applicant: SEIKO EPSON CORPORATION, Tokyo (JP)

(72) Inventor: Makoto Sawadaishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 56 days.

(21) Appl. No.: 16/567,874

(22) Filed: Sep. 11, 2019

(65) Prior Publication Data

US 2020/0079095 A1 Mar. 12, 2020

(30) Foreign Application Priority Data

Sep. 12, 2018 (JP) ..... JP2018-170286

(51) Int. Cl.
*B41J 2/175* (2006.01)

(52) U.S. Cl.
CPC ..... *B41J 2/17513* (2013.01); *B41J 2/1752* (2013.01); *B41J 2/17509* (2013.01); *B41J 2/17553* (2013.01)

(58) Field of Classification Search
CPC .. B41J 2/17513; B41J 2/17509; B41J 2/1752; B41J 2/17503; B41J 2/17506; B41J 29/02; B41J 29/13
See application file for complete search history.

(56) References Cited

U.S. PATENT DOCUMENTS 6,179,415 B1 * 1/2001 Okazaki ..... B41J 2/1752 347/86
6,338,539 B1 * 1/2002 Kobayashi ..... B41J 2/16532 347/108
9,427,972 B2 * 8/2016 Kimura ..... B41J 2/17553
2003/0142176 A1 * 7/2003 Wu ..... B41J 2/17523 347/85
2004/0001128 A1 * 1/2004 Hung ..... B41J 2/17513 347/86
2008/0297571 A1 * 12/2008 Umeda ..... B41J 2/17513 347/85
2015/0284170 A1 * 10/2015 Igarashi ..... B41J 2/145 222/394

(Continued)

FOREIGN PATENT DOCUMENTS

JP 2006-224433 8/2006
JP 2015-199261 11/2015

(Continued)

*Primary Examiner* — John Zimmermann
(74) *Attorney, Agent, or Firm* — Workman Nydegger

(57) ABSTRACT

A liquid ejecting apparatus includes a liquid ejecting head, a carriage, a liquid container, a housing, and a cover. The liquid ejecting head ejects liquid toward a medium transported in a transport direction. The carriage mounts the liquid ejecting head and moves in a main scanning direction intersecting the transport direction of the medium. The liquid container is mounted on the carriage. The liquid container has a containing chamber which contains the liquid to be supplied to the liquid ejecting head and a liquid inlet through which the liquid is poured from a replenishment container into the containing chamber. The housing houses the liquid ejecting head, the liquid container, and the carriage. The cover covers the housing. The housing includes a movement unit that causes the liquid inlet to be exposed to the outside when the movement unit is moved.

15 Claims, 7 Drawing Sheets

(56) References Cited

U.S. PATENT DOCUMENTS

| | | | |
|---|---|---|---|
| 2017/0120643 | A1 | 5/2017 | Igarashi et al. |
| 2018/0272731 | A1 | 9/2018 | Kimura et al. |
| 2018/0272774 | A1 | 9/2018 | Kudo et al. |

FOREIGN PATENT DOCUMENTS

| | | |
|---|---|---|
| JP | 2018-161851 | 10/2018 |
| JP | 2018-161852 | 10/2018 |

* cited by examiner

LIQUID DISCHARGE DEVICE

The present application is based on, and claims priority from JP Application Serial Number 2018-170286, filed Sep. 12, 2018, the disclosure of which is hereby incorporated by reference herein in its entirety.

BACKGROUND

1. Technical Field

The present disclosure relates to a liquid ejecting apparatus.

2. Related Art

Ink jet printers are examples of the related-art liquid ejecting apparatus that ejects liquid to perform printing on a medium. Some of the ink jet printers include a recording head that ejects ink serving as an example of liquid and an ink container that contains the ink. In addition, a carriage movable in a predetermined direction is mounted in these ink jet printers. There are known ink jet printers in which the ink can be poured into the ink container (the ink container is replenished with the ink) as described in JP-A-2006-224433.

With the liquid ejecting apparatus described in JP-A-2006-224433, however, the ink cannot be poured without opening a cover of the device upward when a user wishes to pour the ink. Accordingly, there is a problem in that it is required that the liquid ejecting apparatus be installed with a space provided above the device.

SUMMARY

According to an aspect of the present disclosure, a liquid ejecting apparatus includes a liquid ejecting head, a liquid container, a carriage, a housing, and a cover. The liquid ejecting head ejects liquid toward a medium transported in a transport direction. The liquid container has a containing chamber which contains the liquid to be supplied to the liquid ejecting head. The liquid container also has a liquid inlet through which the liquid is poured into the containing chamber. The liquid ejecting head and the liquid container are mounted on the carriage. The carriage moves in a main scanning direction. The housing houses the liquid ejecting head, the liquid container, and the carriage. The cover covers an upper portion of the housing. The housing includes a movement unit that causes the liquid inlet to be exposed to the outside when the movement unit is moved in the transport direction or in the main scanning direction.

The above-described liquid ejecting apparatus may further include a detector that detects a moved state of the movement unit.

In the above-described liquid ejecting apparatus, the movement unit may have a contact portion brought into contact with the carriage when the carriage is moved while the movement unit is in the moved state, and the detector may include the carriage and the contact portion.

In the above-described liquid ejecting apparatus, the liquid container may include a cap that covers the liquid inlet, and the cap may regulate the movement of the movement unit when the cap does not cover the liquid inlet.

In the above-described liquid ejecting apparatus, at least part of the liquid container may be formed of a transparent material having transparency with which a remaining amount of the liquid contained in the liquid container is visually recognizable.

In the above-described liquid ejecting apparatus, at least part of the movement unit may be formed of a transparent material having transparency with which the liquid container is visually recognizable.

In the above-described liquid ejecting apparatus, the liquid inlet may be open in a direction that includes a transport-direction component.

In the above-described liquid ejecting apparatus, the movement unit may include an absorber.

The above-described liquid ejecting apparatus may further include a movement regulating portion that regulates, when the liquid is poured from the liquid inlet, a movement of the carriage in a direction of gravity.

In the above-described liquid ejecting apparatus, when the carriage is disposed at a first position, the carriage may be in a movement path of the contact portion, and when the carriage is disposed at a second position different from the first position, the carriage may be disposed at a position not in the movement path of the contact portion.

DESCRIPTION OF EXEMPLARY EMBODIMENTS

Figure 1:
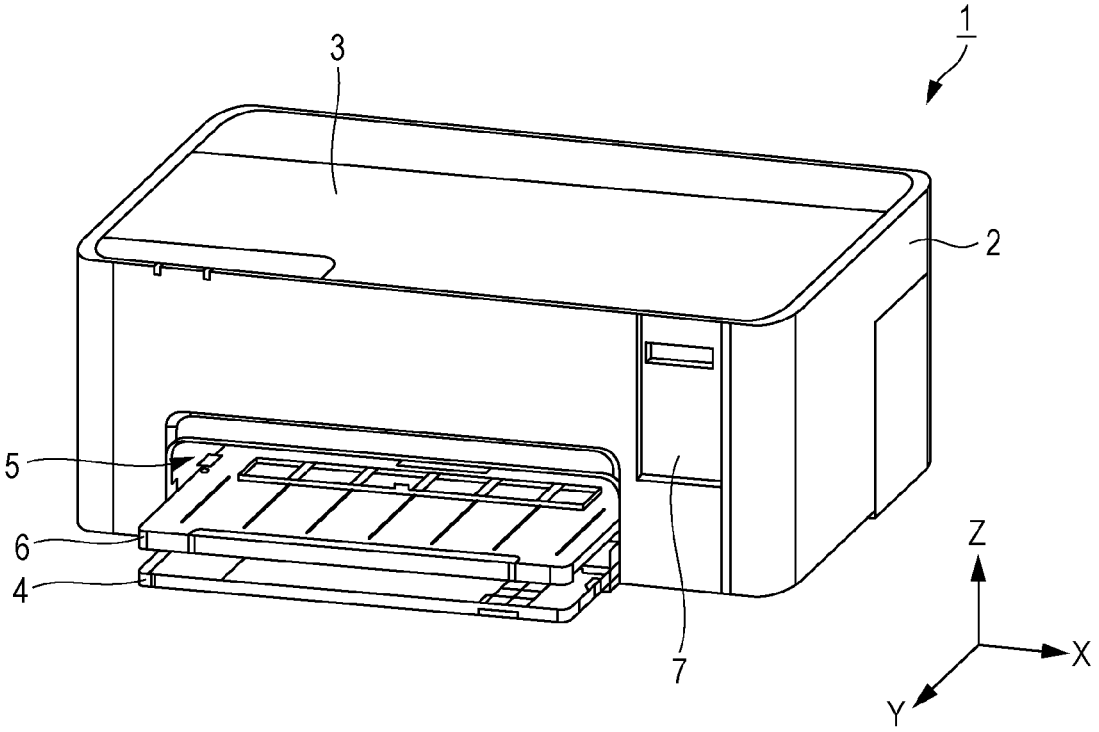
FIG. 1 is an external perspective view of an example of a printer according to a first embodiment.

Embodiments of the present disclosure will be officially described below with reference to the drawings. It is noted that, in the drawings referred to below, members are illustrated at scales different from the actual scales so that the member are drawn in a recognizable size. Also, the same elements or similar elements are denoted by the same reference signs.

First, an example of an outline structure of a liquid ejecting apparatus to which the present disclosure is applied is described. According to the embodiments, an ink jet printer (simply referred to as "printer 1" hereinafter) is described as an example of the liquid ejecting apparatus.

In the X-Y-Z coordinate system illustrated in each of the drawings, the X direction is a direction in which a liquid ejecting head 8 is moved (that is, a direction in which a carriage 10 is moved). The X direction is also the width direction of the printer 1. The Y direction is a direction in which a medium is transported. Also, the Y direction is a depth direction of the printer 1. The Z direction is a height direction of the printer 1. In each of the drawings, the +Y direction is a direction toward the front side or toward the front of the printer 1, and the −Y direction is a direction toward the rear side or toward the rear of the printer 1. The +X direction is a direction toward the right and the −X direction is a direction toward the left when the printer 1 is seen from front.

Furthermore, the +Z direction is a direction toward an upper portion (including the top, an upper surface, and the like) of the printer 1, and the −Z direction is a direction toward a lower portion (including the bottom, a lower surface, and the like) of the printer 1. The main scanning direction of the carriage 10 is the X direction, and a movement unit 7 is moved in the Y direction.

First Embodiment

First, an outline structure of the printer 1 serving as the liquid ejecting apparatus according to a first embodiment is described with reference to FIGS. 1 to 5.

Figure 2:
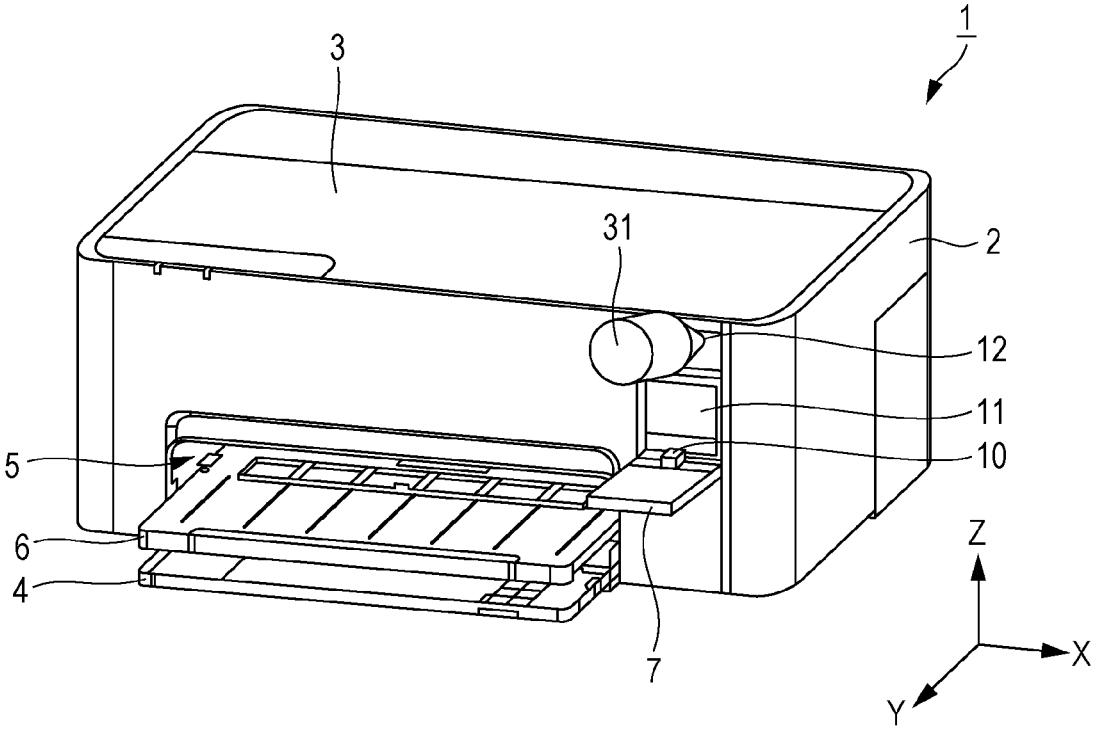
FIG. 2 is an external perspective view of the printer according to the first embodiment when ink is poured.

FIG. 1 is an external perspective view of an example of the printer 1 according to the first embodiment. FIG. 2 is an external perspective view of the printer 1 according to the first embodiment when ink is poured.

Referring to FIGS. 1 and 2, the printer 1 includes a housing 2, a cover 3, a sheet feed tray 4, a sheet output unit 5, and a movement unit 7. The cover 3 covers an upper portion of the housing 2. The sheet feed tray 4 allows media such as sheets of paper (not illustrated) to be set therein. The sheet output unit 5 allows the media after printing to be output thereto. The movement unit 7 covers an ink tank 11 serving as a liquid container housed in the housing 2. A sheet output tray 6 configured such that the sheet output tray 6 can be drawn is provided in the sheet output unit 5.

The housing 2 houses therein the carriage 10, a main frame 21, a belt movement mechanism 22, a carriage motor 24, and a controller 25. The carriage 10 includes the liquid ejecting head 8 and the ink tank 11. The main frame 21, the belt movement mechanism 22, and the carriage motor 24 allow the carriage 10 to be moved in the X direction, which is a main scanning direction A. The controller 25 controls the movement of the carriage 10 (see FIGS. 3 and 5).

The belt movement mechanism 22 powered by the carriage motor 24 causes the carriage 10, on which the ink tank 11 is mounted, to scan in the main scanning direction A along the main frame 21.

The media are each picked from the sheet feed tray 4 and transported toward the rear side of the printer 1 in the housing 2. After that, the medium is reversed and transported toward the front side of the printer 1. When the medium is transported toward the front side of the printer 1, printing is performed with the ink serving as liquid discharged from the liquid ejecting head 8 moving in the main scanning direction A. The medium on which the printing was performed is received in the sheet output tray 6. The transport direction of the medium is the Y direction perpendicular to the X direction, which is the main scanning direction A of the carriage 10.

The components including the liquid ejecting head 8 and the carriage motor 24 are driven by the controller 25.

Furthermore, a liquid inlet 12 provided in the ink tank 11 is exposed to the outside by opening the movement unit 7 to the front side as illustrated in FIG. 2. Thus, the ink is poured from the liquid inlet 12 into the ink tank 11 by using a replenishment container 31.

According to the present embodiment, in a movement region of the carriage 10 when seen from the front of the device, a home-position serving as a first position is provided at an end portion on the right side (+X side) and a liquid-pouring-position serving as a second position is provided at a different position from the home-position further in the −X direction than the home-position.

Figure 3:
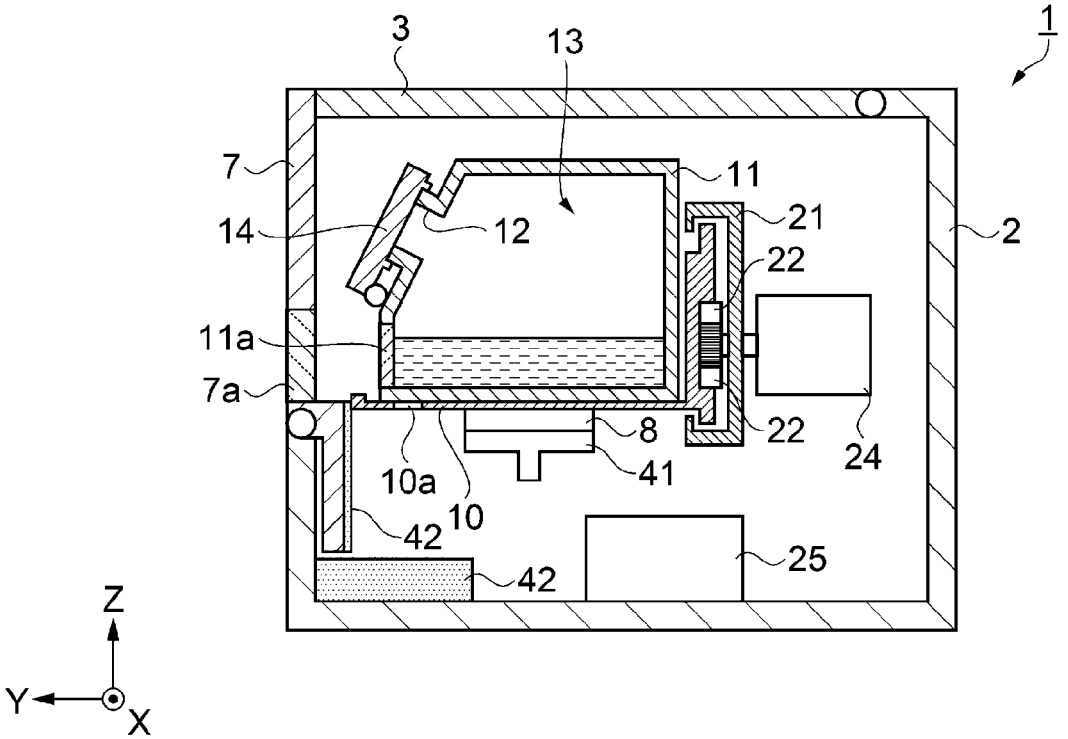
FIG. 3 is a partial sectional view of the device when a carriage according to the first embodiment is in a home-position.
Figure 4:
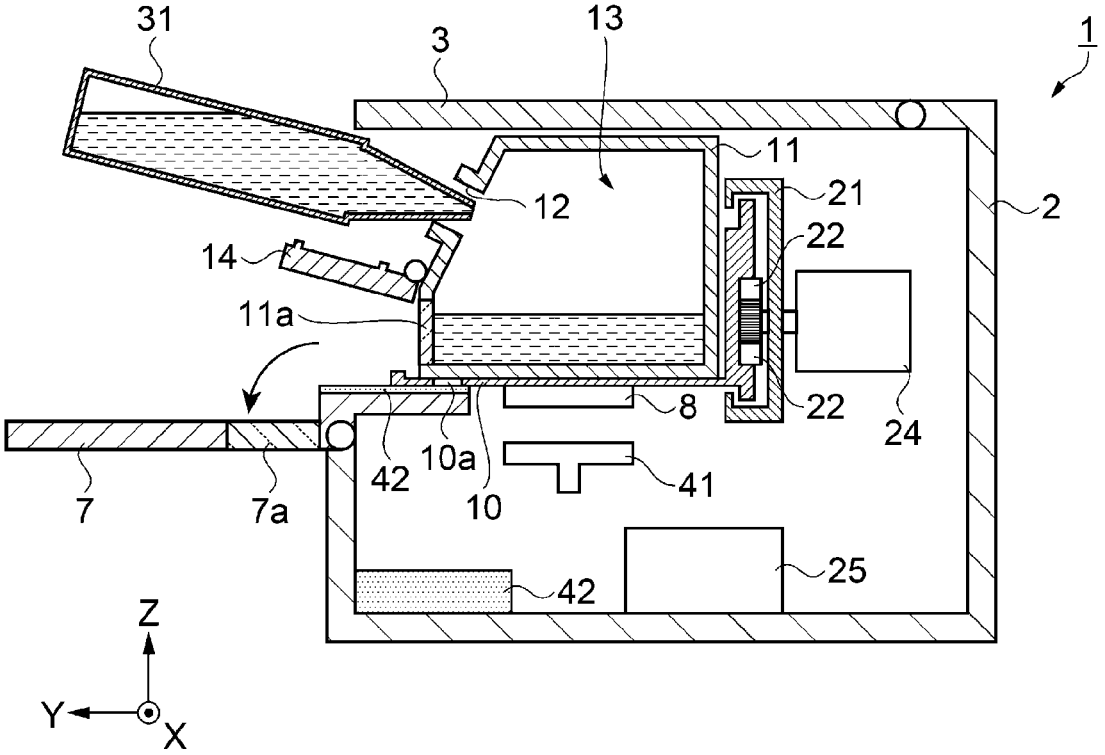
FIG. 4 is a partial sectional view of the device when liquid is poured according to the first embodiment.

FIG. 3 is a partial sectional view of the device when the carriage 10 is in the home-position. FIG. 4 is a partial sectional view of the device when the liquid is poured.

When the carriage 10 is in the home-position, the liquid ejecting head 8 is, as illustrated in FIG. 3, capped with a head cap 41 to suppress drying of head nozzles provided in the liquid ejecting head 8. However, when the carriage 10 is in the liquid-pouring-position to pour the ink, the liquid ejecting head 8 is, as illustrated in FIG. 4, released from the capping with the head cap 41 to suppress damage to the head nozzles that would otherwise be caused by a pressure applied to the liquid ejecting head 8 when the ink is poured.

The carriage 10 is provided with the ink tank 11 having a containing chamber 13 that can contain the ink to be supplied to the liquid ejecting head 8. Furthermore, the carriage 10 has a hole 10*a* at a lower surface. The leaked ink drops downward and is absorbed by one of absorbers 42 provided in a portion of the movement unit 7 near the carriage 10 or another absorber 42 provided at an inner bottom surface of the housing 2. Thus, even when the ink spills during pouring of the ink, leakage of the ink to the outside of the housing 2 can be suppressed.

Furthermore, the ink tank 11 has a liquid inlet 12 through which the ink can be poured from the replenishment container 31. The liquid inlet 12 is disposed above the liquid ejecting head 8, open in a direction including a transport-direction component, and inclined forward. The liquid inlet 12 is covered with a cap 14. This can suppress spilling of the ink from the liquid inlet 12 when the carriage 10 is moved.

Although the ink tank 11 is for a single color (black) according to the present embodiment, a plurality of the ink tanks corresponding to a plurality of colors may be mounted on the carriage 10.

The carriage 10 is moved to the liquid-pouring-position, and the movement unit 7 provided in the housing 2 is moved in the transport direction of the medium. Moving the movement unit 7 in the transport direction means that the movement unit 7 is rotated forward about the X axis so as to be opened. A shaft about which the movement unit 7 is rotated so as to be moved extends in the X direction. When the movement unit 7 is moved, as illustrated in FIG. 4, the liquid inlet 12 can be exposed to the outside. Thus, the ink can be poured from the front side without opening upward the cover 3 that covers the upper portion of the housing 2, and accordingly, a space that would otherwise be required above the printer 1 when pouring the ink becomes unnecessary. Although the cover 3 is disposed at the upper portion of the housing 2 according to the present embodiment, a scanner may be disposed instead of the cover 3.

The ink can be poured into the ink tank 11 as follows: the carriage 10 is moved to the liquid-pouring-position; when the carriage 10 was moved to the liquid-pouring-position, the movement unit 7 is moved in the transport direction; the cap 14 is opened; and the replenishment container 31 is attached to the liquid inlet 12. At this time, the cap 14 is rotated and opened forward such that the cap 14 partially exists in a space of the housing 2 opened due to the movement of the movement unit 7, or, when seen in the X direction, part of the cap 14 remains at rest at a position beyond the housing 2. Accordingly, when the user forgets to close the cap 14, the cap 14 regulates the movement of the movement unit 7. In other words, the movement unit 7 contacts with the cap 14 and cannot be closed. Thus, the user can notice that the user forgets to close the cap 14. Furthermore, when the user also forgets to close the movement unit 7, the cap 14 contacts with the housing 2 so as to regulate the movement of the carriage 10. Thus, the user can notice that the user forgets to close the cap 14.

Figure 5:
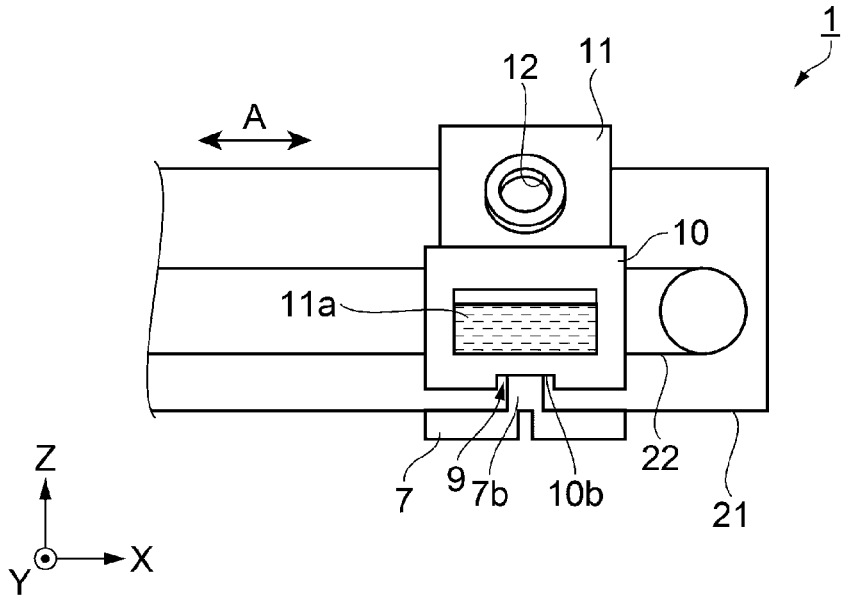
FIG. 5 illustrates effects of the carriage and a contact portion of a movement unit according to the first embodiment.

FIG. 5 is the inside of the housing 2 of the printer 1 seen from the front, illustrating effects of the carriage 10 and a contact portion of the movement unit 7 according to the first embodiment during pouring of the liquid.

As illustrated in FIG. 5, when the carriage 10 is in the liquid-pouring-position, a projection 7*b* and a recess 10*b* are engaged with each other. The recess 10*b* is provided in a portion of the carriage 10 near the movement unit 7 and open toward the movement unit 7. The projection 7*b* is provided in the movement unit 7 and projects toward the carriage 10. The projection 7*b* serves as the contact portion that can be brought into contact with the recess 10*b* of the carriage 10. When the carriage 10 is moved while the movement unit 7 is in the moved state, the projection 7*b* of the movement unit 7 is brought into contact with the recess 10*b* of the carriage 10. Thus, it can be detected that the movement unit 7 is in the moved state. The moved state of the movement unit 7 refers to a state in which the movement unit 7 is moved in the transport direction and the recess 10*b* and the projection 7*b* are engaged with each other. Accordingly, a detector 9 includes the carriage 10 provided with the recess 10*b* and the projection 7*b* provided in the movement unit 7. Although the detector 9 is formed by the recessed and projecting shapes according to the present embodiment, this is not limiting. It is sufficient that the detector 9 be shaped to allow the movement unit 7 and the carriage 10 to be brought into contact with each other so as to limit the movement of the carriage 10.

According to the present embodiment, when the carriage 10 is at the liquid-pouring-position, the recess 10*b* and the projection 7*b* are engaged with each other. Thus, the movement unit 7 can be opened forward, and accordingly, the liquid inlet 12 can be exposed. When the carriage 10 is in the home-position, the projection 7*b* is brought into contact with a portion of the carriage 10 other than the recess 10*b*. Thus, opening of the movement unit 7 can be suppressed. Thus, when the carriage 10 is at the home-position with the power turned off, the movement unit 7 cannot be opened, and accordingly, the ink cannot be poured. Accordingly, failure such as a discharge failure of the liquid ejecting head 8 due to pouring of the ink with the power turned off can be avoided. Furthermore, when the carriage 10 is in neither the home-position nor the liquid-pouring-position during scanning with the carriage 10 in the housing 2, the movement unit 7 can be opened, but due to contact of the projection 7*b* of the movement unit 7 with a side surface of the carriage 10, the carriage 10 cannot be moved to the liquid-pouring-position. Thus, contact of the user with the carriage 10 while the carriage 10 is being moved can be suppressed.

It is assumed that, when the carriage 10 is disposed at the liquid-pouring-position, the movement unit 7 is opened and the ink is poured, and then, the carriage 10 is operated to perform scanning while the movement unit 7 is left unclosed because the user forgets to close the movement unit 7. In this case, according to the present embodiment, contact between the recess 10*b* of the carriage 10 and the projection 7*b* of the movement unit 7 included in the detector 9 due to engagement between the recess 10*b* and the projection 7*b* inhibits movement of the carriage 10. Accordingly, along with the effect of suppressing a situation in which the user forgets to close the movement unit 7, the safety of the user is obtained because the carriage 10 is not moved even when the hand is unintentionally moved into the housing 2.

Furthermore, according to the present embodiment, windows 11*a*, 7*a* are provided at the front sides of the ink tank 11 and the movement unit 7. The windows 11*a*, 7*a* are formed of transparent materials through which the remaining amount of the ink in the ink tank 11 is visually recognizable. Accordingly, even when the ink is poured or the liquid ejecting apparatus is in a standby mode where the movement unit 7 is closed, the amount of the ink in the ink tank 11 can be visually checked. Thus, whether to pour the ink is easily controlled. Although the windows 11*a*, 7*a* formed of the transparent materials are provided in parts of the ink tank 11 and the movement unit 7 according to the present embodiment, this is not limiting. The ink tank 11 and the movement unit 7 may be entirely formed of a transparent material.

As described above, with the printer 1 according to the present embodiment, the following effects can be obtained.

According to the present embodiment, the movement unit 7 is rotated forward about the shaft so as to be moved in the transport direction, thereby the liquid inlet 12 through which the ink is poured can be exposed to the outside. Thus, the ink can be poured from the front side without opening upward the cover 3, and accordingly, a space that would otherwise be required above the printer 1 when pouring the ink becomes unnecessary. Furthermore, since the liquid inlet 12 is open in the direction including the transport-direction component and inclined forward, the ink is easily poured from the front side.

Furthermore, since the parts of the movement unit 7 and the ink tank 11 are formed of the transparent materials having transparency with which the remaining amount of the ink is visually recognizable through the transparent materials, the user easily checks the remaining amount of the ink.

Furthermore, movement of the carriage 10 is regulated by contact between the projection 7*b* of the movement unit 7 and the carriage 10, contact of the user with the carriage 10 while the carriage 10 is being moved can be suppressed.

Furthermore, since the absorber 42 is provided in the portion of the movement unit 7 near the carriage 10, even when the ink drops from the liquid inlet 12, the ink can be absorbed by the absorber 42. Thus, leakage of the ink to the outside of the housing 2 can be suppressed.

Second Embodiment

Next, a printer 1*a* according to a second embodiment is described with reference to FIG. 6.

Figure 6:
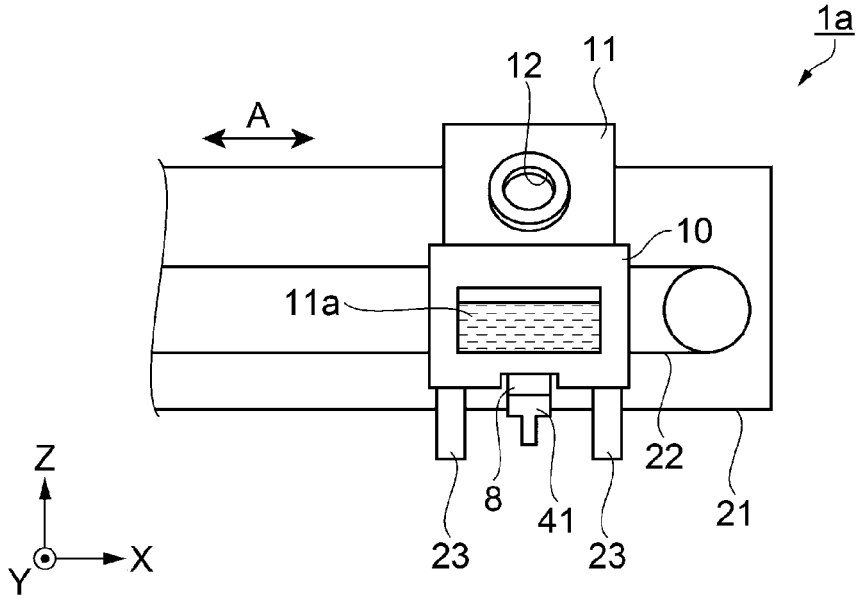
FIG. 6 illustrates effects of movement regulating portions of the printer according to a second embodiment.

FIG. 6 illustrates effects of movement regulating portions 23 of the printer according to the second embodiment. It is noted that the same elements as the elements of the first embodiment are denoted by the same reference signs, and duplicate description thereof is omitted.

According to the present embodiment, the movement regulating portions 23 are provided below the carriage 10 positioned in the liquid-pouring-position. The movement regulating portions 23 regulate movement of the carriage 10 in the direction of gravity. In pouring the ink, when the replenishment container 31 is attached to the ink tank 11 to pour the ink, a force in the direction of gravity is applied to the ink tank 11, and further, to the carriage 10. This destabilizes the carriage 10 and reduces ease of pouring the liquid. When the movement regulating portions 23 are provided, the movement of the carriage 10 in the direction of gravity can be regulated, and accordingly, the carriage 10 is stabilized and ease of pouring the ink into the ink tank 11 is increased.

Typically, when the liquid is poured or the ink tank 11 is replaced, the capping of the liquid ejecting head 8 with the head cap 41 is released. The reason for this is as follows. When the liquid is poured or the ink tank 11 is replaced, a considerable pressing force is applied from above. Thus, when the liquid ejecting head 8 remains capped, a pressurizing force is generated in the liquid ejecting head 8. When the pressurizing force is applied to the liquid ejecting head 8, nozzle menisci of the head are broken, and accordingly, it is difficult to obtain a good printing quality. However, when the liquid ejecting head 8 remains exposed to air, the head nozzles provided in the liquid ejecting head 8 are dried, and accordingly, a good printing quality cannot be obtained. Furthermore, to address this, an additional amount of the ink (liquid) is consumed to clean the head. When movement of the carriage 10 in the direction of gravity is regulated by the movement regulating portions 23, the pressurizing force is not applied even in the case where the liquid ejecting head 8 is capped with the head cap 41. Thus, a liquid pouring operation can be performed with the liquid ejecting head 8 that is still capped. Accordingly, the liquid pouring operation can be performed also in the home-position. This can suppress drying of the head nozzles and reduce the number of times of cleaning.

As described above, with the printer 1*a* according to the present embodiment, the following effects can be obtained in addition to the effects obtained according to the first embodiment.

According to the present embodiment, the movement regulating portions 23 are provided. The movement regulating portions 23 regulate the movement of the carriage 10 in the direction of gravity when the ink is poured from the liquid inlet 12. Thus, a load exerted on the carriage 10 when the ink is poured is reduced, and accordingly, a risk of failure can be reduced. Furthermore, the movement of the carriage 10 in the direction of gravity is suppressed. This allows the ink to be poured when the liquid ejecting head 8 is still capped, that is, when the carriage 10 is in the home-position. Accordingly, drying of the liquid ejecting head 8 can be suppressed, and a good printing quality can be maintained.

Third Embodiment

Next, a printer 1*b* according to a third embodiment is described with reference to FIGS. 7 and 8.

Figure 7:
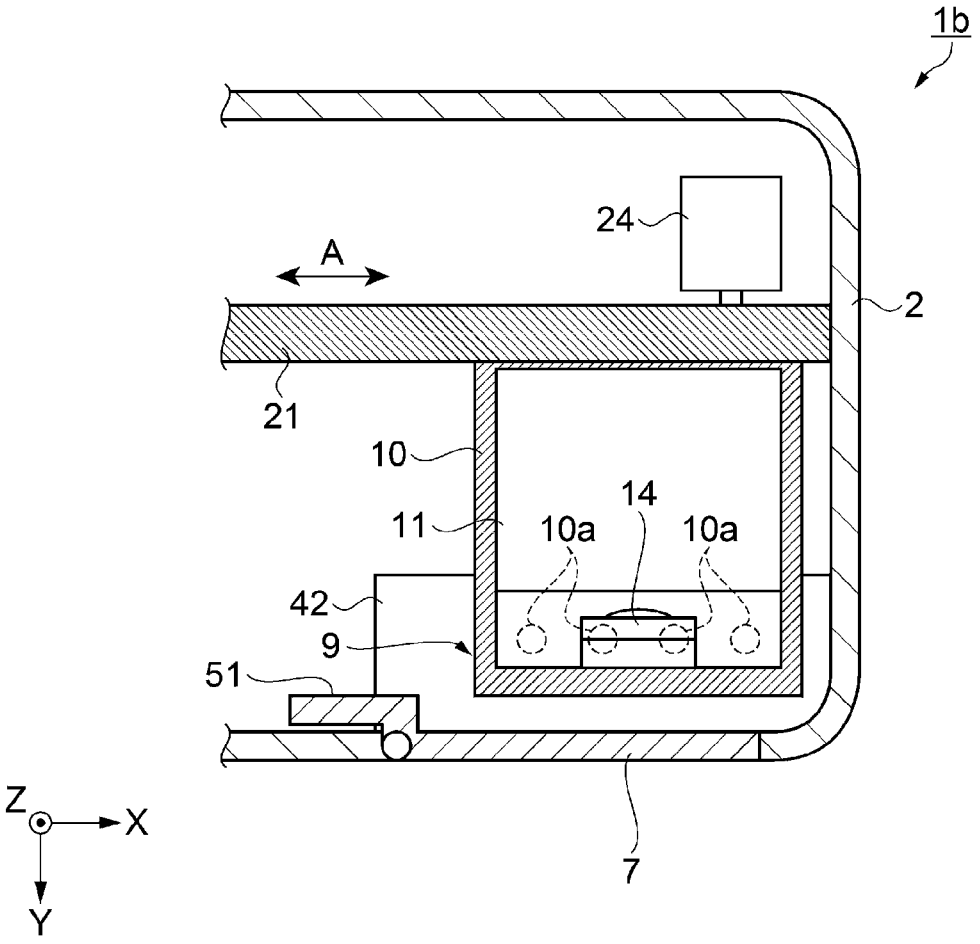
FIG. 7 is a partial sectional view of the device in which a carriage of the printer according to a third embodiment is in a home-position.
Figure 8:
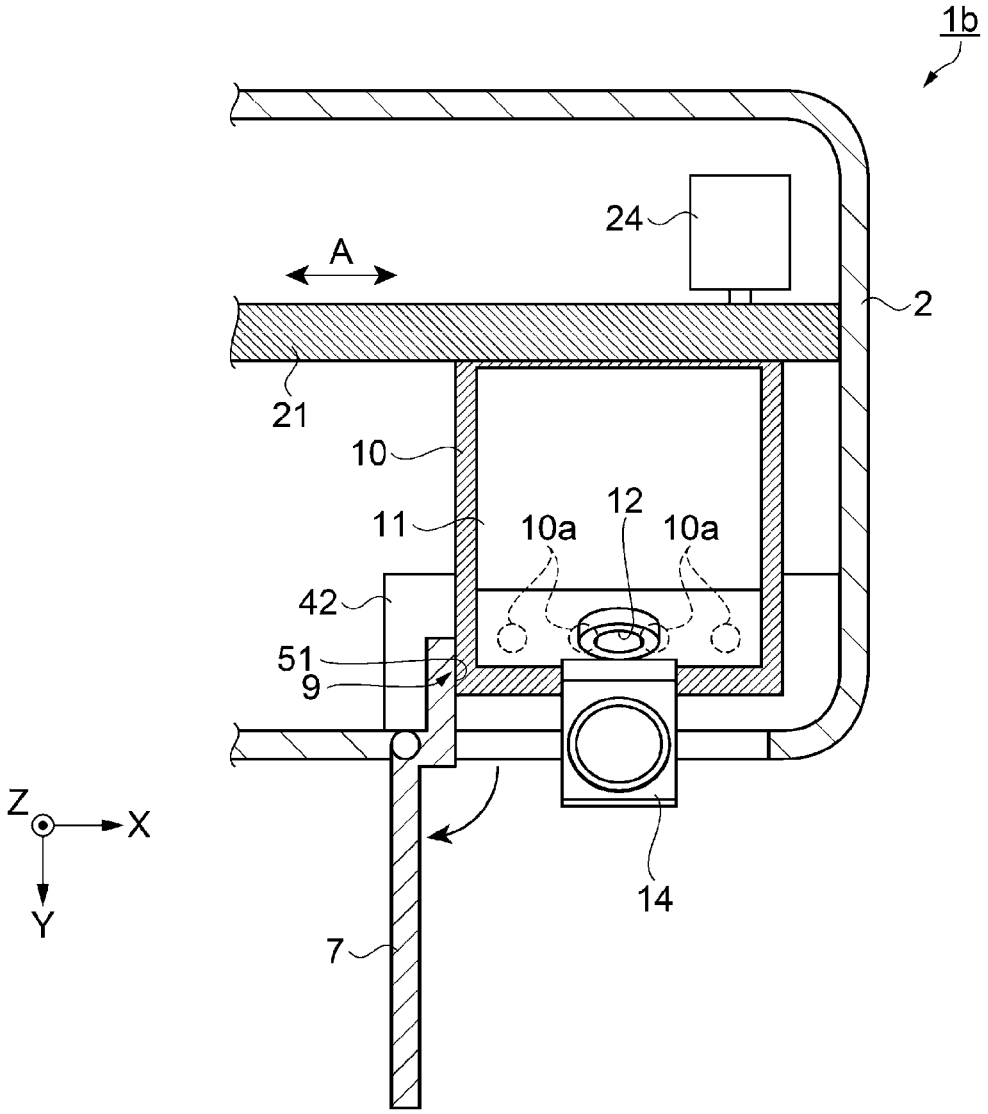
FIG. 8 is a partial sectional view of the device in which the carriage according to the third embodiment is in a liquid-pouring-position.

FIG. 7 is a partial sectional view, seen from above, of the device in which the carriage 10 of the printer 1*b* according to the third embodiment is in the home-position. FIG. 8 is a partial sectional view, seen from above, of the device in which the carriage 10 according to the third embodiment is in the liquid-pouring-position. It is noted that the same elements as the elements of the first embodiment or the second embodiment are denoted by the same reference signs, and duplicate description thereof is omitted.

In the printer 1*b* according to the present embodiment, the shaft for the rotation and the movement of the movement unit 7 extends in the Z direction. When the movement unit 7 is rotated about the Z axis so as to be moved in the transport direction, the liquid inlet 12 can be exposed to the outside. Furthermore, when the carriage 10 is moved while the movement unit 7 is in the moved state, a contact portion 51 of the movement unit 7 is brought into contact with a left side surface of the carriage 10. Thus, it can be detected that the movement unit 7 is in the moved state. That is, as is the case with the first embodiment, the detector 9 includes the contact portion 51 and the carriage 10. Accordingly, along with the effect of suppressing a situation in which the user forgets to close the movement unit 7, the safety of the user is obtained because the carriage 10 is not moved even when the hand is unintentionally moved into the housing 2. In addition, since a possibility of the ink leaking on the movement unit 7 is suppressed, a good plane for visual recognition can be ensured. Furthermore, the absorber 42 is disposed below the carriage 10 in the housing 2. Thus, the ink spilling from the ink tank 11 falls downward through holes 10*a* disposed at the bottom surface of the carriage 10 and is absorbed by the absorber 42. Thus, even when the ink spills during pouring of the ink, leakage of the ink to the outside of the housing 2 is suppressed.

As described above, with the printer 1*b* according to the present embodiment, the following effects can be obtained in addition to the effects obtained according to the first embodiment.

According to the present embodiment, the shaft of the movement unit 7 is different from that of the first embodiment. The movement unit 7 according to the present embodiment is moved horizontally when the movement unit 7 is opened. When the contact portion 51 of the movement unit 7 is brought into contact with the side surface of the carriage 10, it can be detected that the movement unit 7 is in the moved state. Accordingly, unlike the first embodiment, it is not required to provide, for example, a recessed or projecting shape in the contact portion. In addition to the above description, the movement unit 7 is not disposed below the carriage 10. Accordingly, leakage of the ink to the outside of the housing 2 can be suppressed by providing the holes 10*a* at the bottom of the carriage 10 and the absorber 42 in the housing 2.

According to the above-described first to third embodiments, in addition to the carriage 10 and the projection 7*b* or the contact portion 51 serving as the contact portion provided in the movement unit 7, the detector 9 desirably includes the controller 25. When rotary torque of the carriage motor 24 can be detected by the controller 25, the drive load of the carriage motor 24 is detected. When this drive load exceeds a predetermined threshold for a predetermined amount of time, it can be determined that the carriage 10 and the projection 7*b* or the contact portion 51 are brought into contact with each other. Here, the predetermined amount of time is, for example, one second or longer.

Fourth Embodiment

Next, a printer 1*c* according to a fourth embodiment is described with reference to FIGS. 9 and 10.

Figure 9:
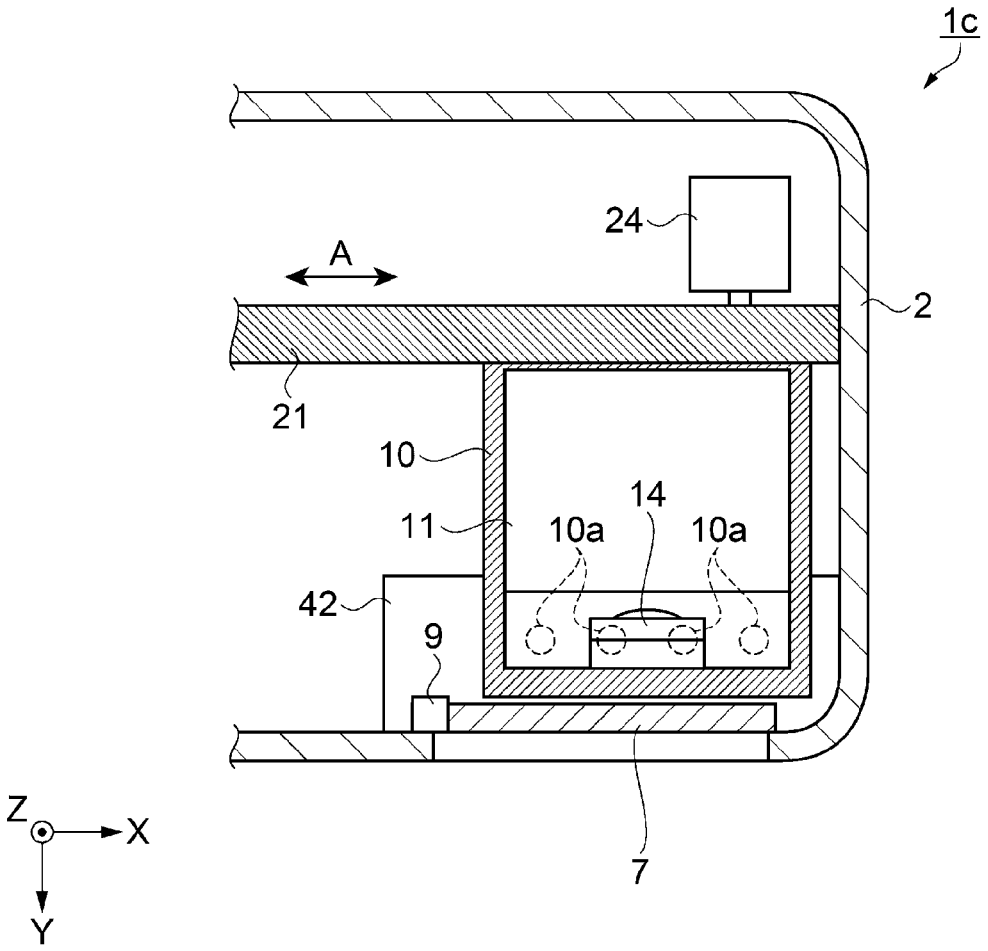
FIG. 9 is a partial sectional view of the device in which a carriage of a printer according to a fourth embodiment is in the home-position.
Figure 10:
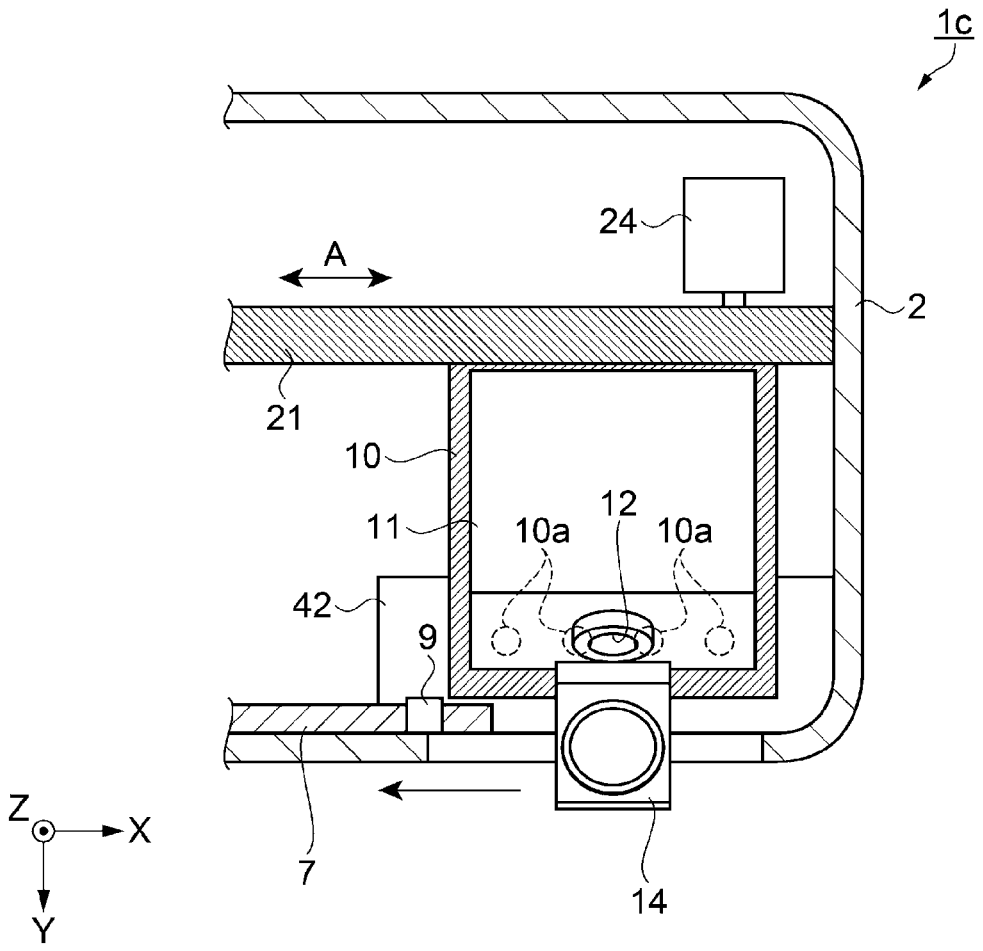
FIG. 10 is a partial sectional view of the device in which the carriage according to the fourth embodiment is in the liquid-pouring-position.

FIG. 9 is a partial sectional view, seen from above, of the device in which the carriage 10 of the printer 1*c* according to the fourth embodiment is in the home-position. FIG. 10 is a partial sectional view, seen from above, of the device in which the carriage 10 according to the fourth embodiment is in the liquid-pouring-position. It is noted that the same elements as the elements of the first, second, or third embodiment are denoted by the same reference signs, and duplicate description thereof is omitted.

In the printer 1*c* according to the present embodiment, the movement unit 7 is slidable. When the movement unit 7 slides in the main scanning direction A, the liquid inlet 12 of the ink tank 11 can be exposed to the outside. Furthermore, the detector 9 such as an optical sensor or a contact sensor that detects the moved state of the movement unit 7, the position of the movement unit 7, and the position of the carriage 10 is provided in the housing 2. When the detector 9 detects a state in which the carriage 10 is operated or a state in which the carriage 10 is in the home-position, a lock mechanism (not illustrated) that regulates the movement of the movement unit 7 is operated.

With the printer 1*c* according to the present embodiment, the following effects can be obtained in addition to the effects obtained according to the first embodiment.

According to the present embodiment, opening/closing of the movement unit 7 can be controlled with the detector 9 such as a sensor instead of detecting the position of the carriage 10 with the carriage 10 and the contact portion including the movement unit 7. Consequently, when the carriage 10 is being operated or in the home-position, the lock mechanism inhibits the movement of the movement unit 7. Thus, the hand of the user does not enter the housing 2, and the safety of the user is obtained. Furthermore, since the movement unit 7 is accommodated in the housing 2, whether to pour the ink is easily controlled.

The above-described embodiments can be varied to have forms such as forms of variations described below. Furthermore, the above-described embodiments and the variations described below can be appropriately combined to obtain further variations, and the variations described below can be appropriately combined with each other to obtain further variations.

According to the above-described embodiments, the liquid inlet 12 may be open in the transport direction in the front surface of the ink tank 11.

Also according to the above-described embodiments, part of the movement unit 7 may cover part of the upper portion of the housing 2. This can reliably allocate, when the movement unit 7 is moved so as to be moved in the transport direction for pouring the ink into the ink tank 11, a space for setting the replenishment container 31. Thus, ease of pouring the ink can be increased. In this case, the liquid inlet 12 may be provided in an upper surface of the ink tank 11 covered by the part of the movement unit 7.

Furthermore, the home-position may be used as the liquid-pouring-position without the movement regulating portions 23.

Content introduced from the embodiments are described below.

A liquid ejecting apparatus includes a liquid ejecting head, a liquid container, a carriage, a housing, and a cover. The liquid ejecting head discharges liquid toward a medium transported in a transport direction. The liquid container has a containing chamber which contains the liquid to be supplied to the liquid ejecting head. The liquid container also has a liquid inlet through which the liquid is poured into the containing chamber. The liquid ejecting head and the liquid container are mounted on the carriage. The carriage moves in a main scanning direction. The housing houses the liquid ejecting head, the liquid container, and the carriage. The cover covers an upper portion of the housing. The housing includes a movement unit that causes the liquid inlet to be exposed to the outside when the movement unit is moved in the transport direction or the main scanning direction.

With this structure, the movement unit is moved in the transport direction or the main scanning direction to allow the liquid inlet to be exposed to the outside. Thus, the liquid can be poured from the liquid inlet of the liquid container at the front of the device without opening the cover that covers the upper portion of the housing. Thus, a space above the liquid ejecting apparatus is not required, and accordingly, versatility in installation of the liquid ejecting apparatus can be increased.

Preferably, the above-described liquid ejecting apparatus further includes a detector that detects a moved state of the movement unit.

With this structure, the moved state of the movement unit can be detected by the detector. Thus, the liquid can be poured into the liquid container and contact of the user with the carriage while the carriage is being moved can be suppressed.

In the above-described liquid ejecting apparatus, the movement unit preferably has a contact portion brought into contact with the carriage when the carriage is moved while the movement unit is in the moved state, and the detector preferably includes the carriage and the contact portion.

With this structure, the carriage and the contact portion function as the detector. Thus, the moved state of the movement unit can be detected without a separately provided sensor, and accordingly, the cost can be reduced.

In the above-described liquid ejecting apparatus, the liquid container preferably includes a cap that covers the liquid inlet, and the cap preferably regulates the movement of the movement unit when the cap does not cover the liquid inlet.

With this structure, the movement unit cannot be returned to the original position while the cap is open. This can suppress the occurrence of a situation in which the user forgets to close the cap. This can also suppress spilling of the liquid from the liquid inlet when the carriage is moved.

In the above-described liquid ejecting apparatus, at least part of the liquid container is preferably formed of a transparent material having transparency with which a remaining amount of the liquid contained in the liquid container is visually recognizable.

With this structure, since the liquid container is formed of a member having transparency with which the liquid is visually recognizable, the remaining amount of the liquid in the containing chamber can be visually checked when the movement unit is moved.

In the above-described liquid ejecting apparatus, at least part of the movement unit is preferably formed of a transparent material having transparency with which the liquid container is visually recognizable.

With this structure, since the movement unit is formed of a member having transparency with which the inside of the housing is visually recognizable, the remaining amount of the liquid contained in the liquid container can be visually checked without moving the movement unit.

In the above-described liquid ejecting apparatus, the liquid inlet is preferably open in a direction that includes a transport-direction component.

With this structure, since the liquid inlet is open in the direction including the transport-direction component, the liquid is easily poured from the front side of the liquid ejecting apparatus.

In the above-described liquid ejecting apparatus, the movement unit preferably includes an absorber.

With this structure, the absorber is provided in the movement unit. Thus, even when the liquid drops from the liquid inlet, the liquid can be absorbed by the absorber. Accordingly, leakage of the liquid to the outside of the housing can be suppressed.

Preferably, the above-described liquid ejecting apparatus further includes a movement regulating portion that regulates, when the liquid is poured from the liquid inlet, a movement of the carriage in a direction of gravity.

With this structure, even in the case where a force is applied in the direction of gravity of the carriage when the liquid is poured, the movement in the direction of gravity can be regulated by the movement regulating portion. Thus, load exerted on the carriage when the liquid is poured is reduced, and accordingly, a risk of failure can be reduced. Furthermore, since the movement in the direction of gravity is suppressed, the liquid can be poured while the liquid ejecting head is still capped. Accordingly, drying of the liquid ejecting head can be suppressed, and a good printing quality can be maintained.

In the above-described liquid ejecting apparatus, when the carriage is disposed at a first position, the carriage is preferably in a movement path of the contact portion, and when the carriage is disposed at a second position different from the first position, the carriage is preferably disposed at a position not in the movement path of the contact portion.

With this structure, when the carriage is disposed at the second position being the liquid-pouring-position, the movement unit is movable. Thus, the liquid inlet can be exposed to the outside, and accordingly, the liquid can be poured from the liquid inlet. In contrast, when the carriage is disposed at the first position being the home-position, the movement unit is not movable. Thus, the liquid inlet cannot be exposed to the outside, and accordingly, the liquid cannot be poured from the liquid inlet. Accordingly, when the carriage is disposed at a position other than the second position, pouring of the liquid can be limited.

What is claimed is:

1. A liquid ejecting apparatus comprising:

a liquid ejecting head that ejects liquid toward a medium transported in a transport direction;

a liquid container that has a containing chamber which contains the liquid to be supplied to the liquid ejecting head and that has a liquid inlet through which the liquid is poured into the containing chamber;

a carriage on which the liquid ejecting head and the liquid container are mounted and which moves in a main scanning direction;

a housing that houses the liquid ejecting head, the liquid container, and the carriage; and a cover that covers an upper portion of the housing; wherein the housing includes a movement unit that is configured to move without opening the cover and is configured to expose the liquid inlet to outside when the movement unit is moved, and the liquid inlet is configured to allow the liquid to be poured from the liquid inlet in a state where the liquid container is installed on the carriage when the movement unit is moved.

2. The liquid ejecting apparatus according to claim 1, further comprising:

a detector that detects a moved state of the movement unit.

3. The liquid ejecting apparatus according to claim 2, wherein the movement unit has a contact portion brought into contact with the carriage when the carriage is moved while the movement unit is in the moved state, and wherein the detector includes the carriage and the contact portion.

4. The liquid ejecting apparatus according to claim 1, wherein the liquid container includes a cap that covers the liquid inlet, and wherein the cap regulates the movement of the movement unit when the cap does not cover the liquid inlet.

5. The liquid ejecting apparatus according to claim 1, wherein at least part of the liquid container is formed of a transparent material having transparency with which a remaining amount of the liquid contained in the liquid container is visually recognizable.

6. The liquid ejecting apparatus according to claim 5, wherein at least part of the movement unit is formed of a transparent material having transparency with which the liquid container is visually recognizable.

7. The liquid ejecting apparatus according to claim 1, wherein the liquid inlet is open in a direction that includes a transport-direction component.

8. The liquid ejecting apparatus according to claim 1, wherein the movement unit includes an absorber.

9. The liquid ejecting apparatus according to claim 1, further comprising:

a movement regulating portion that regulates, when the liquid is poured from the liquid inlet, a movement of the carriage in a direction of gravity.

10. The liquid ejecting apparatus according to claim 3, wherein, when the carriage is disposed at a first position, the carriage is in a movement path of the contact portion, and wherein, when the carriage is disposed at a second position different from the first position, the carriage is disposed at a position not in the movement path of the contact portion.

11. The liquid ejecting apparatus according to claim 1, wherein the movement unit is provided on a front side of the housing.

12. The liquid ejecting apparatus according to claim 1, wherein the liquid inlet is configured to allow the liquid to be poured from a front side of the housing.

13. The liquid ejecting apparatus according to claim 1, wherein the liquid inlet opens at least partially towards a front side of the housing.

14. The liquid ejecting apparatus according to claim 1, wherein:

the liquid container has a top side that faces a top side of the housing and a front side that is connected to the top side of the liquid container and at least partially faces a front side of the housing, and the liquid inlet is disposed on the front side of the liquid container.

15. The liquid ejecting apparatus according to claim 1, wherein:

the liquid container has a horizontal side, vertical side, and an inlet side that is connected to the horizontal side and the vertical side, and the liquid inlet is disposed on the inlet side of the liquid container.

* * * * *